United States Patent [19]

Kohr

[11] 4,204,444

[45] May 27, 1980

[54] BAND SAW GUARD DEVICE

[76] Inventor: John M. Kohr, 598 Western Ave., Magnolia, Mass. 01930

[21] Appl. No.: 8,380

[22] Filed: Feb. 1, 1979

[51] Int. Cl.[2] ..... B26D 7/22

[52] U.S. Cl. ..... 83/56; 83/544; 83/814

[58] Field of Search ..... 83/13, 56, 814, 544, 83/545, 546, 860

[56] References Cited

U.S. PATENT DOCUMENTS

| | | | |
|---|---|---|---|
| 2,538,456 | 1/1951 | Howe, Jr. | 83/814 |
| 3,974,724 | 8/1976 | Shadle | 83/814 X |

*Primary Examiner*—J. M. Meister

*Attorney, Agent, or Firm*—Richard L. Stevens

[57] ABSTRACT

A protective device for a band saw machine is secured to the guards which are normally found on such machines. The device extends downwardly from the guards to the plane of the table, on which the blocks to be cut are placed. The device encloses the band saw and prevents inadvertent contact therewith. The device comprises two members, a fixed member secured to the guard and a movable member secured to the fixed member. The movable member is locked to the fixed member. When a block contacts the device the movable member is released until the block has been cut. The movable member returns to the locked position after the block has been cut.

8 Claims, 4 Drawing Figures

BAND SAW GUARD DEVICE

BACKGROUND AND BRIEF SUMMARY OF THE INVENTION

In cutting block material, such as frozen fish fillets, the blocks are placed on a reciprocating table and are passed repeatedly through a saw and typically a band saw. These band saws generally employ a protective guard about the blade to prevent injury. For machines commonly available today the guard only extends downwardly a predetermined amount leaving the blade exposed a distance between the table which carries the block, upwardly to some point just above the block to be cut, hereinafter referred to as a cutting zone. More particularly an exposed portion of the band saw exists which is typically greater than the height of the blocks to be cut.

As will be readily apparent the exposed blade presents a safety hazard. Therefore there exists a need for a blade guard which will completely enclose the band saw at all times except when a block to be cut is passing through the band saw.

My invention provides a device for enclosing a band saw which device when used with the protective guards currently available, completely encloses the band saw. The only time the band saw in the cutting zone is exposed is when a block is moving through the zone. This prevents the possibility of injury to an operator when the band saw is operating and a block is not being cut.

The device is responsive to the movement of a block to be cut. When the block to be cut engages the device, the device is moved to an open position and the band saw is exposed to the block. The device rides over the block and returns to a closed locked position after the block has passed through the band saw.

Broadly the invention comprises a device which may be secured to an existing protective guard of a band saw machine or separately secured to the machine. The device is secured adjacent to the band saw and extends throughout the cutting zone. The device comprises a fixed member secured to the machine, the member of elongated configuration extending into the cutting zone. Secured to the lower end of the fixed member is a locking assembly adapted to be actuated by a block of material to be cut. A movable member is secured to the fixed member, the lower end of the movable member extending through the cutting zone and adapted to be held in the closed position by the locking assembly. The movable member when locked forms with the fixed member a guide in the cutting zone adjacent the band saw which prevents inadvertent contact with the band saw.

DESCRIPTION OF THE PREFERRED EMBODIMENT

Figure 1:
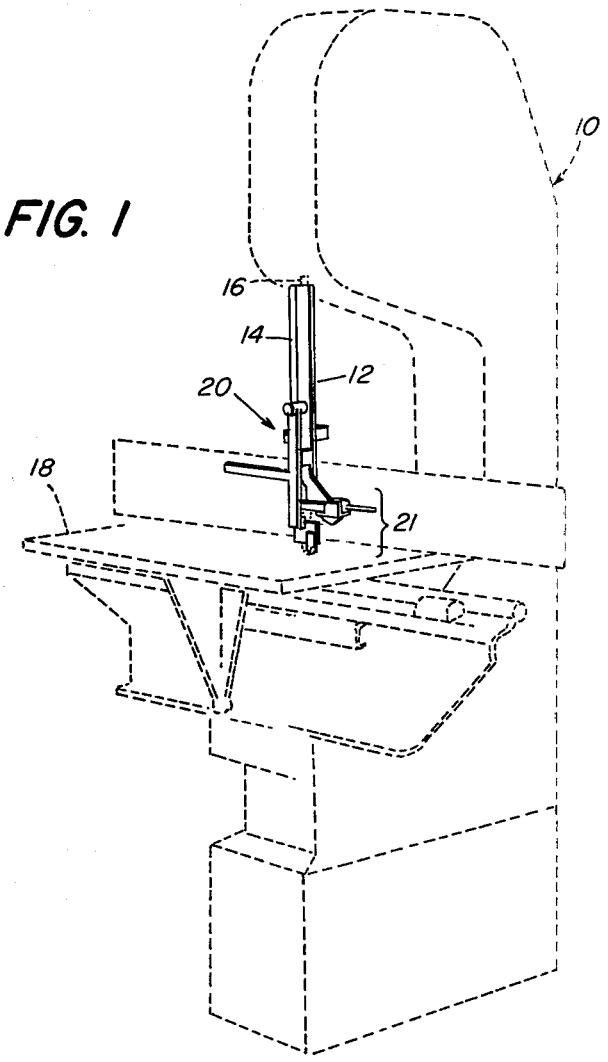
FIG. 1 is a perspective view of a prior art band saw cutting machine shown in dotted lines with an embodiment of the invention shown in solid lines.

Referring to FIG. 1, a standard slicing machine 10 such as a Pearce Heavy Duty Band Saw Model 5D as manufactured by Pearce and Company, Inc., Danvers, Massachusetts, is shown in dotted lines. As is customary, right angle guards 12 and 14 are secured about the band saw 16 to form a rectangular shaped protective guard. A movable table 18 carries the blocks to be cut. The guards are permanently secured to the machine. For purposes of this application the zone between the lower ends of the guards 12 and 14 and the plane of the movable table 18 is defined as a cutting zone 21.

The device 20 embodying my invention is bolted to the guard 12 and extends downwardly therefrom to a point just above the movable table 18.

Figure 2:
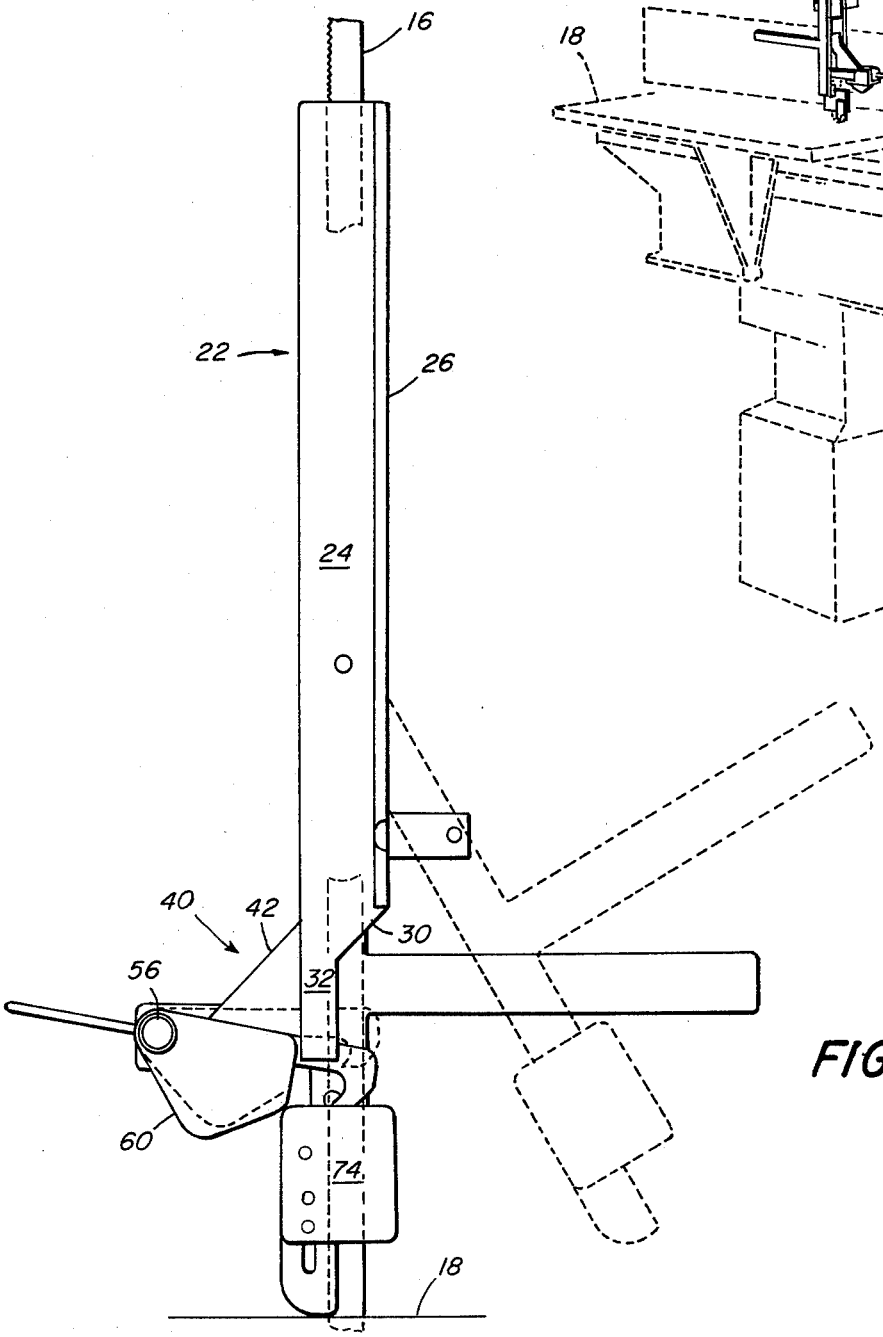
FIG. 2 is a back elevation of the device of the preferred embodiment of this invention.
Figure 3:
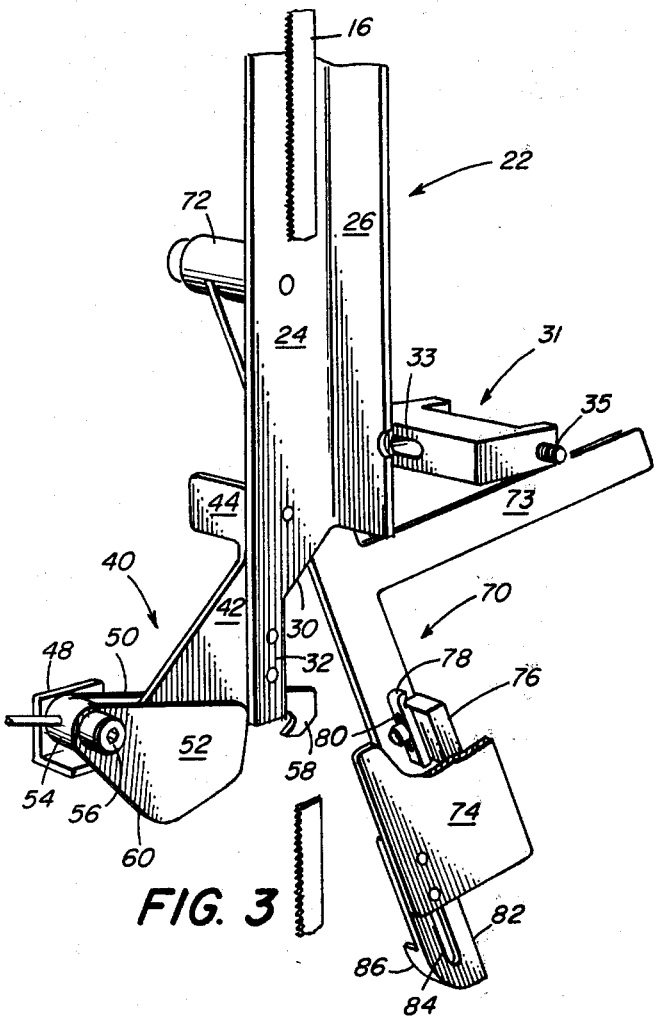
FIG. 3 is a perspective illustration of the device of FIG. 1.
Figure 4:
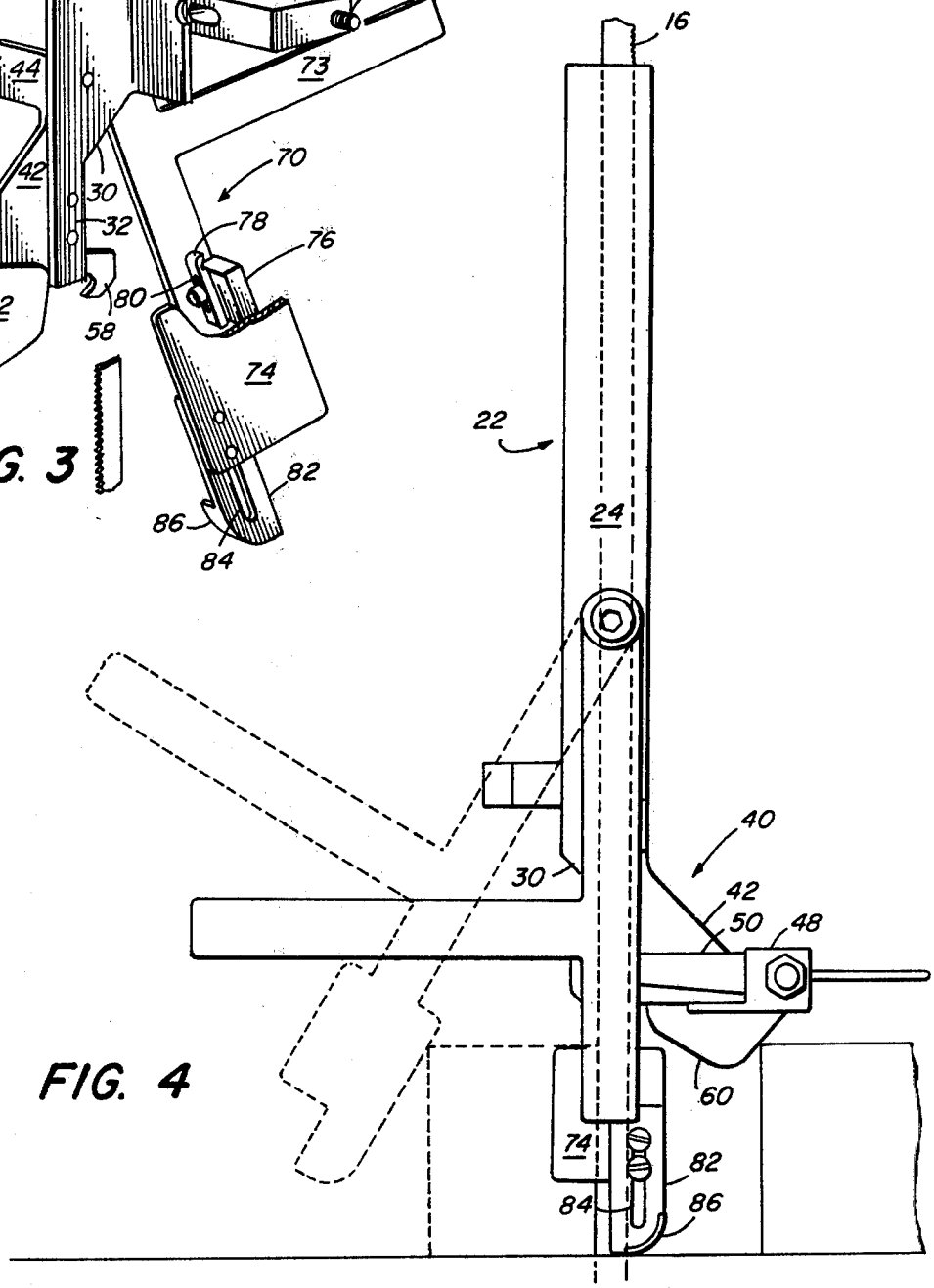
FIG. 4 is a front elevation of the device of FIG. 1.

Referring to FIGS. 2, 3 and 4, the device 20 includes an elongated fixed member 22 comprising slides 24 and 26, their edges joined at right angles one to the other. The side 24 is bolted at its upper end to the guard 12. At the lower end of the side 24 a shoulder 30 is formed which results in an extending portion 32 of reduced cross-sectional area. The inner opposed surfaces of the sides 24 and 26 are about the band saw. The member 22 is substantially parallel to the rotating band saw 16. A locking assembly 40 is secured such as by bolts on the outer surface of the side 24. The assembly 40 includes a triangular shaped support plate 42 parallel to the side 24. A stop flange 44 extends perpendicularly outward from the plate 42 to limit the travel of a movable member 70 to a closed position as will be described. Formed at the bottom edge of the plate 42 is a base 46 extending perpendicularly outward. Extending upwardly from the base and parallel to the plate 42 is a support flange 48. The support flange 48 extends a fixed distance from the end of the base 46 inwardly toward the stop flange 44. A locking arm 50 and counterweight 52 are joined as an integral unit to a common sleeve 54 in spaced apart parallel relationship. A bolt or pin 56 secures them in a pivotal manner to the support flange 48. The locking arm is a planar elongated member which extends inwardly toward the extending portion 32 and terminates with a downwardly extending dog 58. The counterweight 52 includes a lower camming surface 60 such that when it is engaged by a block to be cut both the counterweight and locking arm will move upwardly as will be described.

The movable arm 70 is adapted for movement between a closed locked position, shown in solid lines in FIGS. 2 and 4, and an open position shown in dotted lines in FIG. 2.

The movable member 70 is planar and terminates at its upper end in a sleeve 72. The member 70 is parallel to the side 24 and the longitudinal axis of the sleeve 72 is perpendicular to the plane of the member 70. A bolt or similar structure passes through the sleeve 72 and is secured to the side 24 whereby the member 70 is rotatably pinned thereto. An arm 73 extends perpendicularly outward from the member 70 to balance and assist the member 70 in returning to its closed position.

The lower end of the member 70 has a substantially rectangular plate 74 spaced apart in parallel relationship from the member 70 and joined thereto by a section 76. This is seen most clearly in FIG. 3. Adjustably secured to the section 76 is a lip 78 with a slot 80. The lip 78 is adjusted to engage the dog 58 when the member 70 is in its closed position.

Adjustably secured to the plate 74 is an elongated guide 82 having a slot 84. When the member 70 is in its closed position the guide 82 is positioned just above the plane of the table 18 and the members 22 and 70 form a guard about the band saw 16 in the cutting zone 21. The lower end of the guide 82 terminates in an extended cammed surface 86 which rides over the block being cut.

Secured to the side 26 is a guide block 31 having a slot 33 and adjustable screws 35. As the widths of the block to be cut in such machines vary, a guide arm (not shown) is used to ensure that a cut less than the desired width will not be processed further with the properly cut pieces. Such a guide arm is received at the slot 33 and the screw 35 varies the distance between the band saw and guide arm as desired.

Referring to FIG. 4 in the operation of the invention a block 100 to be cut is placed on the movable table 18. As the block moves toward the band saw 16 it engages the camming surface 60 shown in solid lines. As it continues to move the dog 58 of the locking arm 50 moves upwardly disengaging the dog 58 from the lip 78 thus releasing the member 70. As the block 100 moves forward the member 70 continues to move through its open position as shown in dotted lines. After the block has passed though the band saw the member 70 returns to its locked position engaging the dog 58. The stop flange 44 on the locking assembly 40 limits the rearward movement of the member 70. The counterbalance 52 on the locking assembly 40 also insures that the dog is in the appropriate position to lock the member 70 when it returns.

Other modifications to the invention described within the skill of the art are within the scope of this invention.

Having described my invention, what I now claim is:

1. In a machine having a band saw rotating adjacent to a movable table, the table adapted to carry blocks to be cut by the band saw the machine including a protective guard about the band saw, the band saw normally being exposed in a cutting zone, the zone comprising at least the distance from the movable table carrying the block to a location above the block being cut the improvement which comprises:

a device secured to the machine and adjacent the band saw, the device disposed in the cutting zone and adapted to shield the blade from contact except when a block to be cut is moved therethrough, the device comprising;

a fixed member secured to the machine adjacent the band saw, said fixed member having an upper end and a lower end, a counterbalanced locking assembly rotatably pinned to the lower end of the fixed member the locking assembly having a lower camming surface adapted to engage the block being cut;

a movable member secured to the fixed member and adapted for rotatable movement from a closed position adjacent the band saw to an open position, said movable member having an upper end and a lower end, means at the lower end of the movable member to engage the locking assembly of the fixed member, and means to maintain the movable member biased to a locked position whereby when the block engages the cammed surface the locking assembly disengages from the movable member and the movement of the block rotates the movable member from its closed position to an open position.

2. The device of claim 1 wherein:

the locking assembly is biased downwardly and includes a release arm having a downwardly extending dog, and the lower camming surface is formed to move the locking assembly upwardly when the assembly is contacted by the block to be cut.

3. The device of claim 1 which includes:

means secured to the fixed member to limit the rotatable movement of the movable member after it has reached the closed position.

4. The device of claim 3 wherein:

the means to limit the movement is a stop flange secured to the locking assembly.

5. The device of claims 1, 2, 3 or 4 wherein the movable member at its lower end includes an adjustable plate secured thereto in spaced apart parallel relationship, and further wherein the plate includes a guide means on the bottom portion thereof which is adapted to ride over the block as it passes through the band saw.

6. The device of claim 5 wherein an upwardly extending lip is secured between the plate and the lower end of the movable arm the lip adapted to engage the locking assembly when the movable member is in its closed position.

7. A method for enclosing a band saw to prevent inadvertant contact therwith by an operator, wherein a device is secured to a band saw machine and adjacent the band saw, the device extending upwardly from the plane of a table on which blocks to be cut are carried, the device having a fixed member having a counterbalanced locking assembly secured at the lower end thereof, the locking assembly including a camming surface; a movable member secured to the fixed member for movement between a closed position adjacent and guarding the band saw to an open position which method includes:

engaging the lower camming surface by movement of a block to be cut the block disposed on the table;

deflecting upwardly, the locking assembly to release the movable member from the fixed member;

rotating the movable member from a closed to an open position by movement of the block to be cut thereby exposing the band saw;

passing the block through the band saw;

locking the movable member to the closed member after the block has completed its travel through the band saw the movable member moving from its open position to its closed position.

8. The method of claim 7 which includes;

limiting the movement of the movable member after it has reached its closed position.

* * * * *